US009228805B1

(12) United States Patent
Littlestone et al.

(10) Patent No.: US 9,228,805 B1
(45) Date of Patent: Jan. 5, 2016

(54) CORRUGATED BLAST FREQUENCY CONTROL PANEL AND METHOD

(71) Applicants: Alyssa A. Littlestone, Washington, DC (US); Philip J. Dudt, North Bethesda, MD (US)

(72) Inventors: Alyssa A. Littlestone, Washington, DC (US); Philip J. Dudt, North Bethesda, MD (US)

(73) Assignee: The United States of America as represented by the Secretary of The Navy, Washington, DC (US)

( * ) Notice: Subject to any disclaimer, the term of this patent is extended or adjusted under 35 U.S.C. 154(b) by 0 days.

(21) Appl. No.: 14/690,525

(22) Filed: Apr. 20, 2015

Related U.S. Application Data

(63) Continuation-in-part of application No. 13/974,115, filed on Aug. 23, 2013, now Pat. No. 9,046,325.

(60) Provisional application No. 61/723,896, filed on Nov. 8, 2012.

(51) Int. Cl.
*F41H 5/007* (2006.01)
*F41H 5/04* (2006.01)
*B21D 13/00* (2006.01)

(52) U.S. Cl.
CPC ..... *F41H 5/007* (2013.01); *B21D 13/00* (2013.01)

(58) Field of Classification Search
CPC ..... F41H 5/04; F41H 5/007; F41H 5/0471; F41H 5/023; B21D 13/00
See application file for complete search history.

(56) References Cited

U.S. PATENT DOCUMENTS

| | | | | |
|---|---|---|---|---|
| 2,110,322 | A * | 3/1938 | Calzavara | 109/81 |
| 2,316,055 | A * | 4/1943 | Davey | 89/36.05 |
| 2,405,590 | A * | 8/1946 | Mason | 109/81 |
| 3,228,361 | A * | 1/1966 | Ritter | 109/84 |
| 3,636,895 | A * | 1/1972 | Kelsey | 109/78 |
| 4,965,138 | A | 10/1990 | Gonzalez | |
| 5,007,326 | A | 4/1991 | Gooch, Jr. et al. | |
| 5,184,800 | A * | 2/1993 | Tabler | 256/12.5 |
| 6,459,836 | B1 * | 10/2002 | Bocanegra et al. | 385/107 |
| 7,415,806 | B2 | 8/2008 | Davidson | |
| 8,757,041 | B1 | 6/2014 | Gillen | |
| 2004/0237763 | A1 | 12/2004 | Bhatnagar et al. | |

OTHER PUBLICATIONS

R.H. Cole, Diaphragm Gauges, Underwater Explosions, Princeton University Press, Princeton, N.J. (1948), pp. 157-159.

G.J. Cooper, Protection of the Lung from Blast Overpressure by Thoracic Stress Wave Decouplers, Journal of Trauma: Injury, Infection and Critical Care, vol. 40, No. 3, (March Supplement 1996), S105-S110.

(Continued)

*Primary Examiner* — Jeanette E Chapman
(74) *Attorney, Agent, or Firm* — Richard A. Morgan

(57) ABSTRACT

A composite panel includes a ballistic fabric strike surface layer and an underlying structural armor plate layer. The structural armor plate layer is corrugated and includes a multiplicity of traversing ports. The traversing ports have sufficient lateral area to allow explosive blast deformation of the ballistic fabric through the structural armor plate layer. By selecting both relative port traversing void area and corrugation angle an effective projectile blockage is achieved. The composite shield is particularly effective in protecting personnel. Blast frequencies in the 1000 to 3000 Hz Cooper Injury Range component of the blast wave spectrum are attenuated. The panel has projectile shredding properties and has improved structural stability.

13 Claims, 11 Drawing Sheets

(56) References Cited

OTHER PUBLICATIONS

G.J. Cooper, et al. The Role of Stress Waves in Thoracic Visceral injury from Blast Loading: Modification of Stress Transmission by Foams and High-Density Materials, Journal of Biomechanics, vol. 24, No. 5, pp. 273-285 (1991).

A.A. Littlestone et al., Blast Frequency Control for Personnel Survivability, NSWCCD, West Bethesda, MD, Technical Report NSWCCD-66-TR-2012/20 (Aug. 2012).

A.A. Littlestone et al., Coupling Perforated Plate with Ballistic Fiber Plies to Control Transmitted Blast Pressure and Critical Frequency, NSWCCD, West Bethesda, MD, Technical Report NSWCCD-66-TR-2012/37 (Dec. 2012).

Department of Defense Test Method Standard. V50 Ballistic Test for Armor, MIL-STD-662F, Dec. 18, 1997.

* cited by examiner

FIG 6a
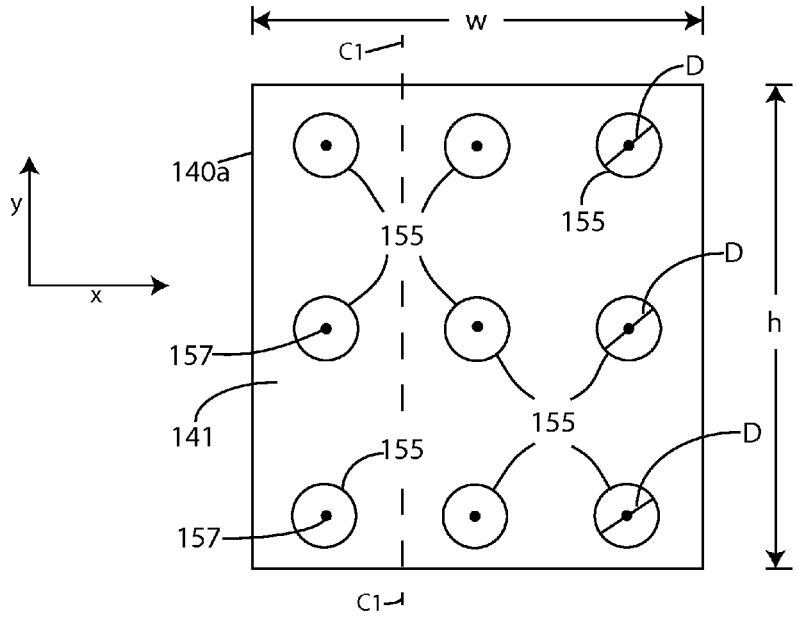
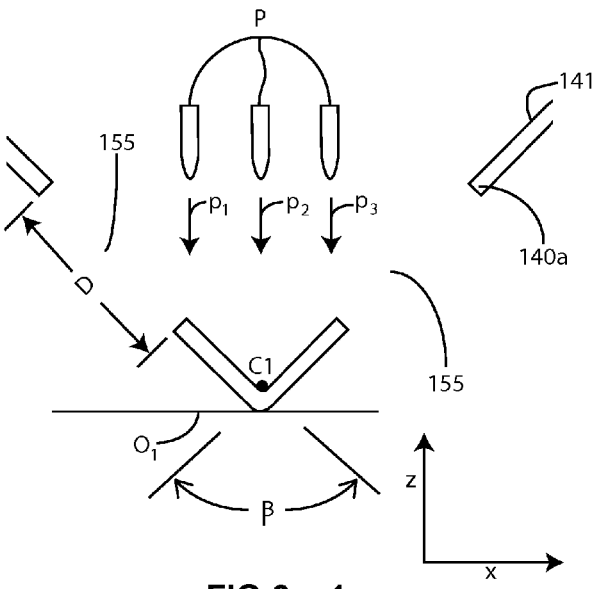
FIG 6e -1
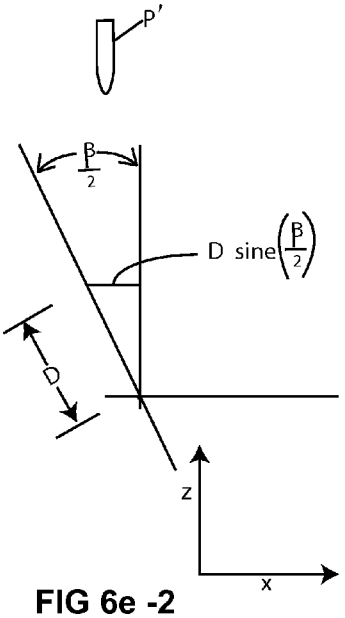
FIG 6e -2

CORRUGATED BLAST FREQUENCY CONTROL PANEL AND METHOD

CROSS-REFERENCE TO RELATED APPLICATIONS

This application is a continuation-in-part of application Ser. No. 13/974,115 filed Aug. 23, 2013 for the invention of an Explosive Blast Frequency Control Shield and Method, now U.S. Pat. No. 9,046,325, by Alyssa A. Littlestone and Philip J. Dudt. Ser. No. 13/974,115, now U.S. Pat. No. 9,038,332, claims the benefit of provisional application 61/723,896 filed Nov. 8, 2012. These applications are incorporated herein by reference it their entirety.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The invention relates to ordnance, particularly to an explosive blast shield. More particularly, the invention relates to a composite panel having explosive blast frequency mitigating components and projectile shredding components. The invention is also a method of making a blast frequency control panel.

2. Discussion of the Related Art

Explosive blast attack against people in open areas and in buildings is a challenge in the armor arts. The primary defense against opportunistic blast attack is a perimeter barrier such as a steel reinforced concrete wall. However, explosive blast generates a pressure wave that continues past an ordinary concrete vehicle barrier. If a large explosive load is detonated, the pressure wave can travel with enough force to cause traumatic brain and lung injury to people superficially protected behind concrete walls and inside buildings.

The mechanisms that result in traumatic brain injury have been investigated. Suggested mechanisms include blast compression of body cavities to generate vascular pulses that are transmitted to the brain, skull deflection, explosively-generated piezoelectric charge formation from loading on the bones of the skull, blast induced cerebral spinal fluid cavitation and direct transmission of pressures and blast wave accelerations sufficient to induce injury into the brain. G. J. Cooper investigated the connection between blast frequencies and injury to human tissue. He found that the frequency range of 1000 and 3000 Hz is particularly damaging to lung tissue. This damaging frequency range is referred to in the Drawing as the Cooper Injury Range. This work is reported in G. J. Cooper "Protection of the Lung from Blast Overpressures by Thoracic Stress Wave Decouplers", *Journal of Trauma: Injury, Infection, and Critical Care*, vol. 40, no. 3 (1996), incorporated herein by reference. One method of reducing some of the injury to humans would be to limit exposure to blast frequencies in this range.

Investigations of potential barrier panels have identified blast wave couplers and de-couplers. Simple soft foams increased blast damage to the thorax. This damage was attributed to coupling the blast more effectively with the body. However when high impedance materials, such as high Young's modulus and/or density materials, were used as a facing and backed with a low impedance material such as soft foam, blast wave decoupling was observed. Blast decoupling resulted in less internal damage to the human body.

Investigators have found that textiles exhibit differing behaviors in response to blast pressure loadings. Vests comprising certain textile materials altered blast pressure loading on the thorax. One study found that a ballistic fabric vest increased blast associated injury. Another study indicated that blast pressure loading on the body could be reduced if textile fibers were pre-compressed rather than loose assembly.

The scientific literature reports that initiation of lung damage for one-time blast exposure is a function of peak pressure and duration (impulse). We have not found a definitive determination of the mechanism for traumatic brain injury in the relevant scientific literature. It is reported that blast exposure sufficient to cause brain injury may be less than for lung damage.

There is a continuing need in the ordnance shield arts for an effective explosive blast panel. To be fully effective in protecting human tissue, a panel shield must protect against the force of an explosive blast pressure wave and particularly limit exposure to the most damaging blast frequencies.

SUMMARY OF THE INVENTION

A blast frequency control panel comprises at least two abutting layers: a corrugated structural armor plate layer and a strike surface layer. The corrugated structural armor plate layer has a generally planar orientation and has a face surface.

The corrugated structural armor plate layer is defined by a series of vertically elongated, straight, parallel, alternating ridges and V-groves. Each V-groove has a pair of facing, generally flat lateral surfaces with an included intersection angle of 60° to 90° there between.

The strike surface layer comprises a layer of ballistic fabric that covers the generally flat lateral surfaces. It is essential that the strike surface layer is a continuous piece of ballistic fabric to facilitate extension of the fabric and elongation of the constituent fibers. The ballistic fabric has physical properties including:

i. a tensile strength of 45,000 lb./in$^2$ (pounds/square inch) or greater, ii. a Young's modulus of 700,000 lb./in$^2$ (pounds/square inch) or greater, and iii. an elongation at break of 2% or greater.

Regularly spaced sharp edged ports traverse the flat lateral surfaces. Each traversing port also has sufficient lateral area to allow blast-induced extension of the ballistic fabric into and through the traversing ports. More ballistic fabric is provided than necessary to merely cover the ports. The additional ballistic fabric, in combination with port diameters of 0.1 inches to 0.5 inches is sufficient to allow blast induced traverse of ballistic fabric through the ports without rupturing the fabric.

The corrugated structural armor plate layer has a face surface projectile blockage of 0.6 to 0.8. The face surface projectile blockage is defined by the number 1.00 minus a quotient of the sum of lateral port areas divided by the structural armor plate layer surface area.

In addition, the projectile blockage is enhanced by the included intersection angle of the corrugation. The blast frequency control panel has a total projectile blockage perpendicular to the generally planar orientation. The total projectile blockage is defined by the number 1.00 minus the product of the face surface projectile blockage multiplied by the sine of a half angle of the included intersection angle.

The ballistic fabric-faced panel has blast force dissipating properties. In addition, the panel has been found to reduce blast frequencies, particularly in the damaging 1000 to 3000 Hz Cooper Injury Range. The amount of reduction in this Cooper Injury frequency range has been found to be sufficient to reduce human tissue injury. The sharp edges defining the ports in combination with the armor plate also have projectile shredding capability. The panel is used for shielding humans from traumatic blast including damaging blast frequencies.

BRIEF DESCRIPTION OF TEE DRAWING

The drawing is for purpose of illustration only and is not intended to limit the scope of the invention. In the accompanying Drawing figures.

Figure 5A:
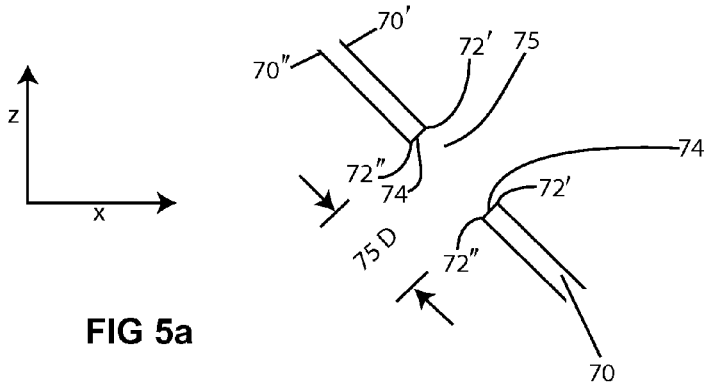
FIG. 5 is a cross-sectional view of a 90° V-groove corrugation structural armor plate, the section taken through ports to show them.
Figure 5:
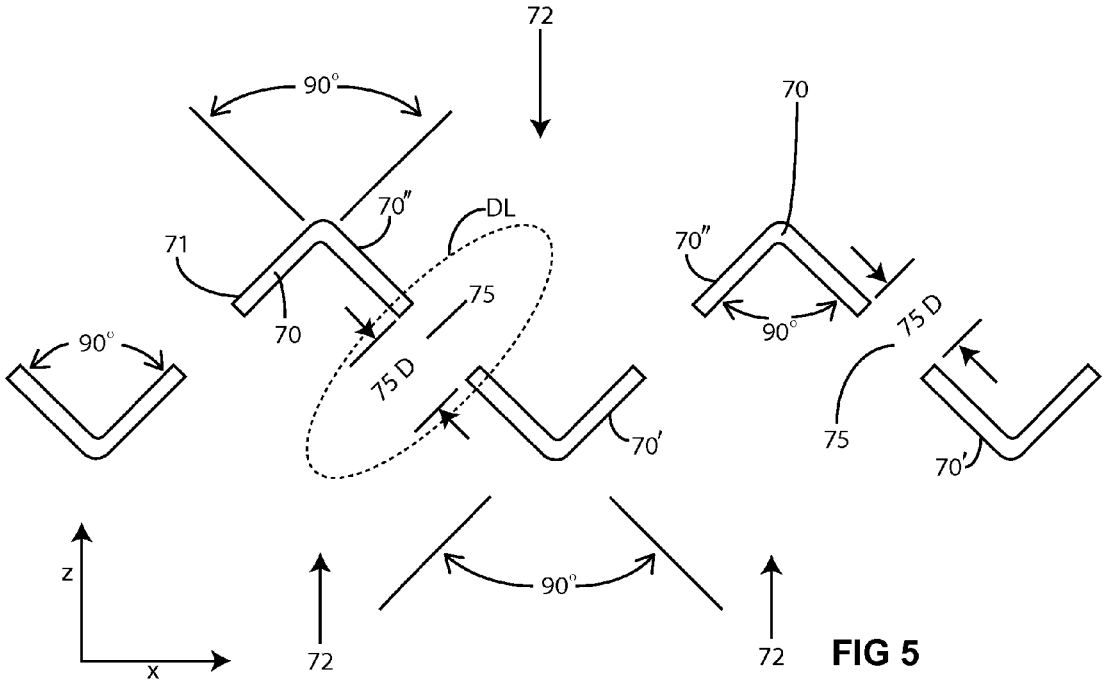

FIG. 5*a* is a magnified view of a port identified in FIG. 5 by dotted line DL.

FIG. 6*a* is a schematic representation showing the parameters defining face surface projectile blockage.

Figure 6B:
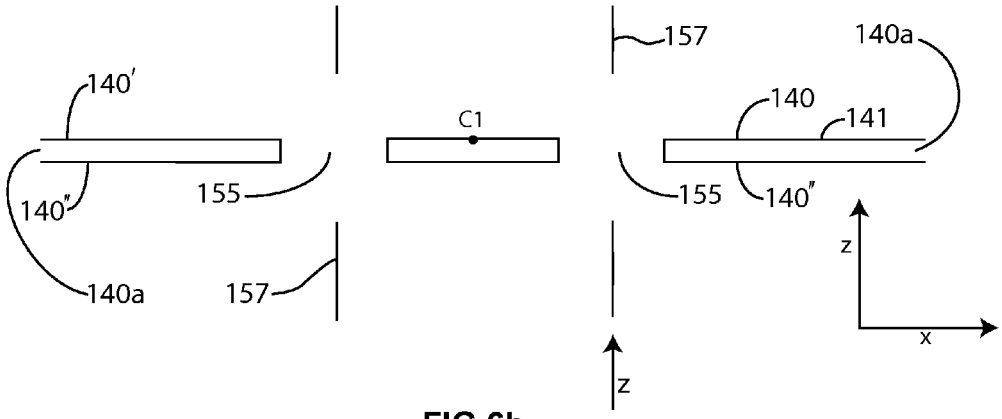
Figure 6C:
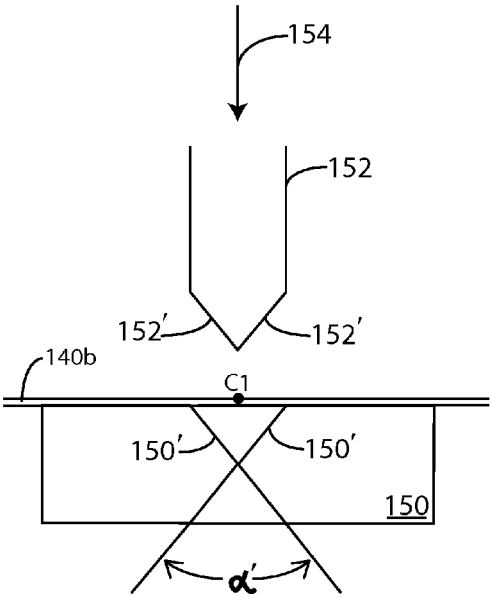
Figure 6D:
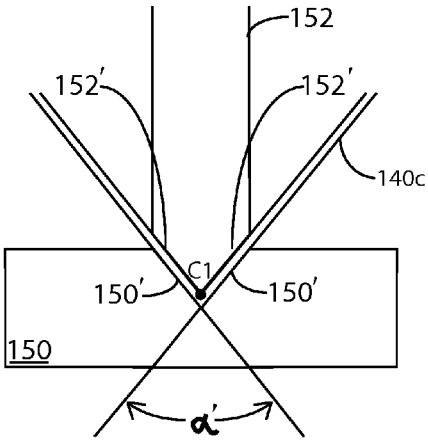

FIG. 6*b*, FIG. 6*c* and FIG. 6*d* are schematic cross-sectional views of a structural armor plate showing a sequence of corrugation forming events. FIG. 6*b* shows port forming. FIG. 6*c* and FIG. 6*d* show V-shaped grove forming.

Figure 1:
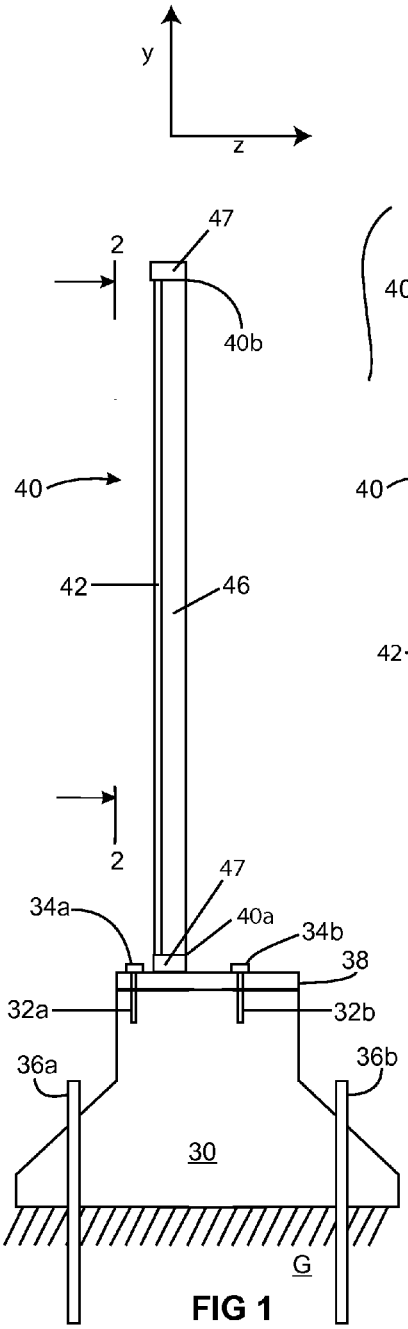
FIG. 1 is a cross-sectional side view of a panel in combination with a vehicle barrier.
Figure 2:
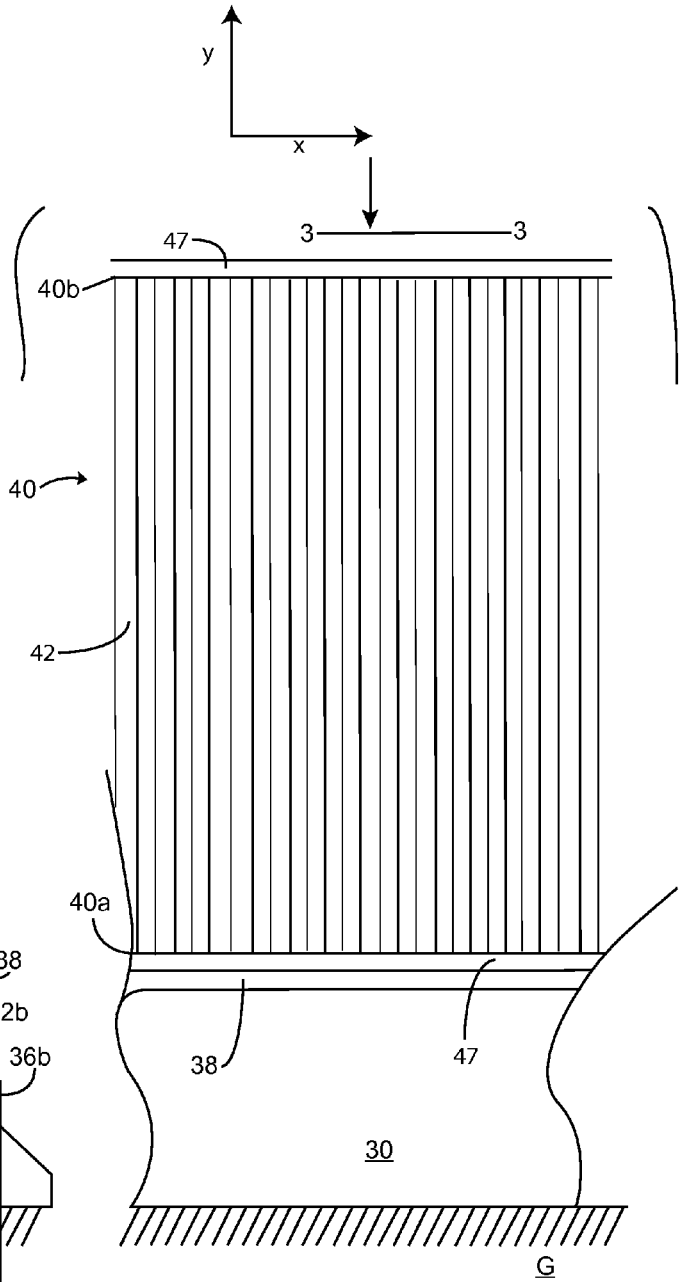
FIG. 2 is a frontal view of the panel along section 2-2 in FIG. 1.

FIG. 6*e*-1 and FIG. 6*e*-2 are schematic representations showing the parameters defining total projectile blockage.

Figure 7:
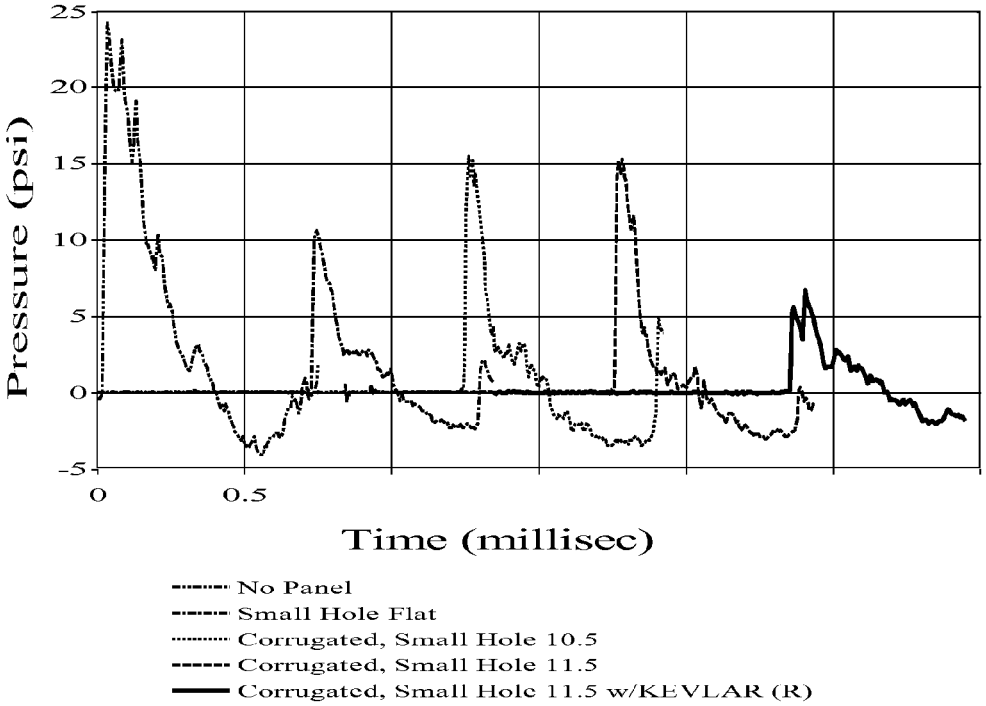

FIG. 7 is a graph of pressure versus time data for four small port panels tested in Example 1.

Figure 8:
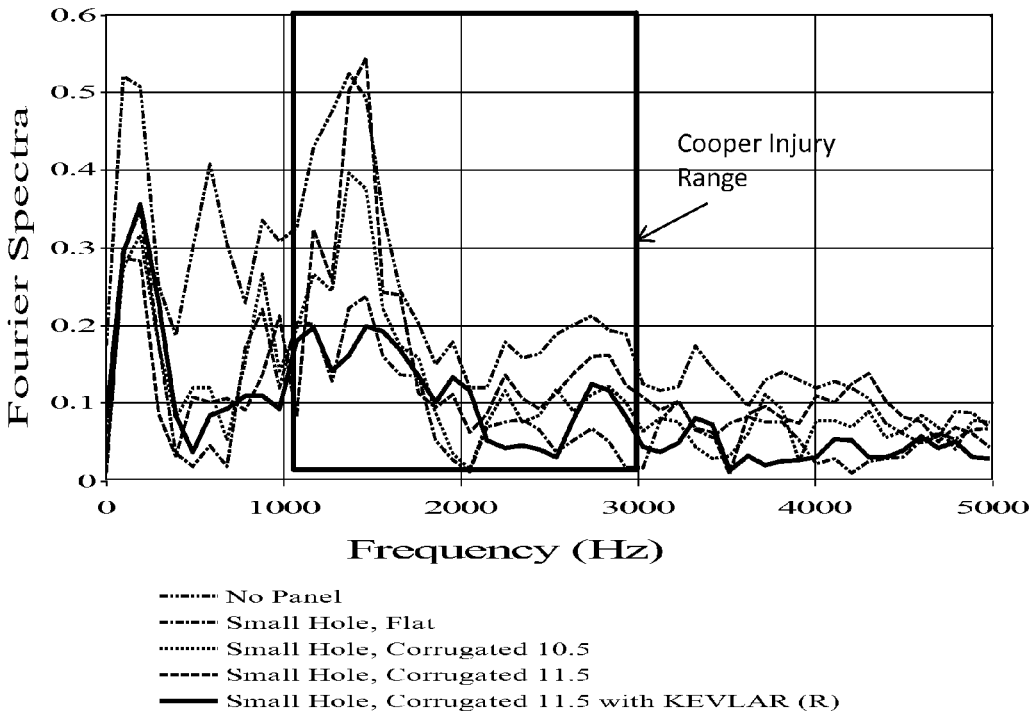

FIG. 8 is a graph of Fourier spectra data versus frequency for four small size port panels tested in Example 1.

Figure 9:
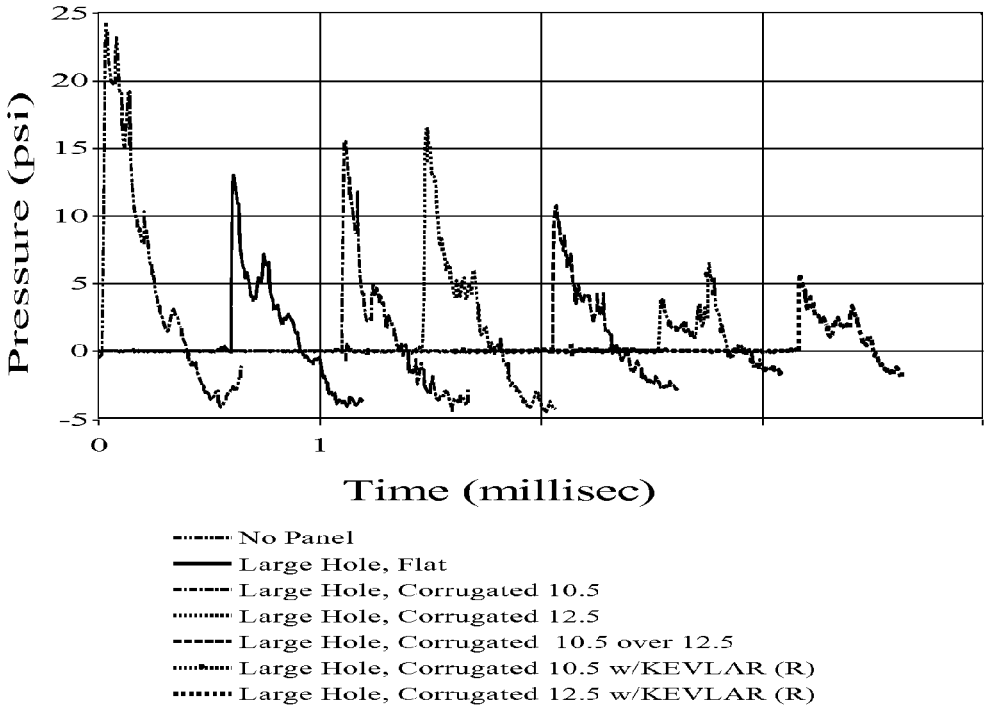

FIG. 9 is a graph of pressure versus time data for six medium size port panels tested in Example 2.

Figure 10:
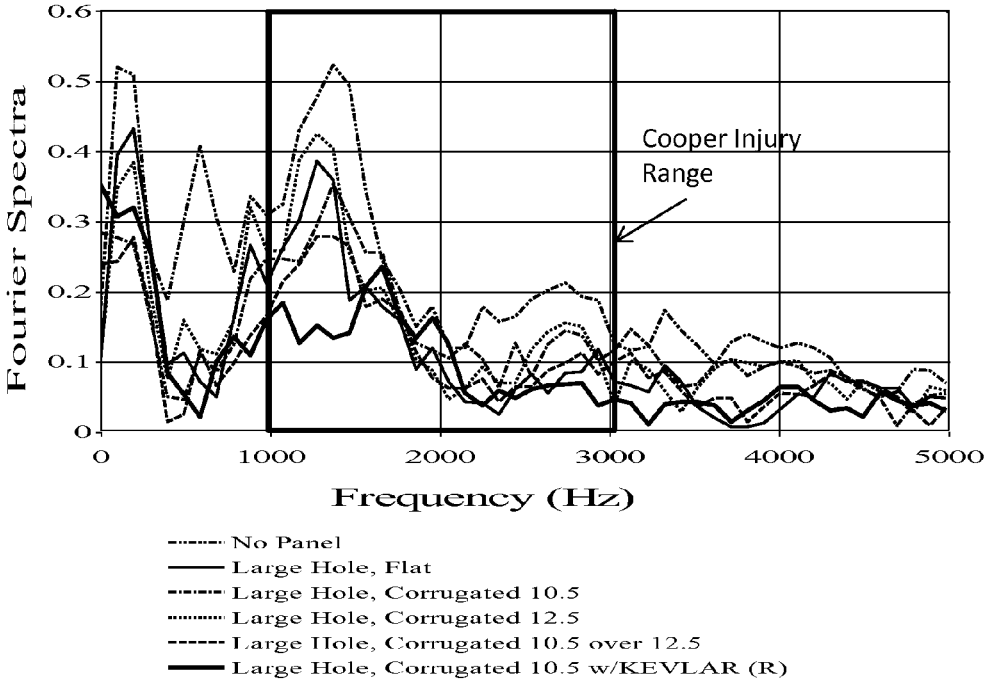

FIG. 10 is a graph of Fourier spectra data versus frequency for six medium size port panels tested in Example 2.

Figure 11:
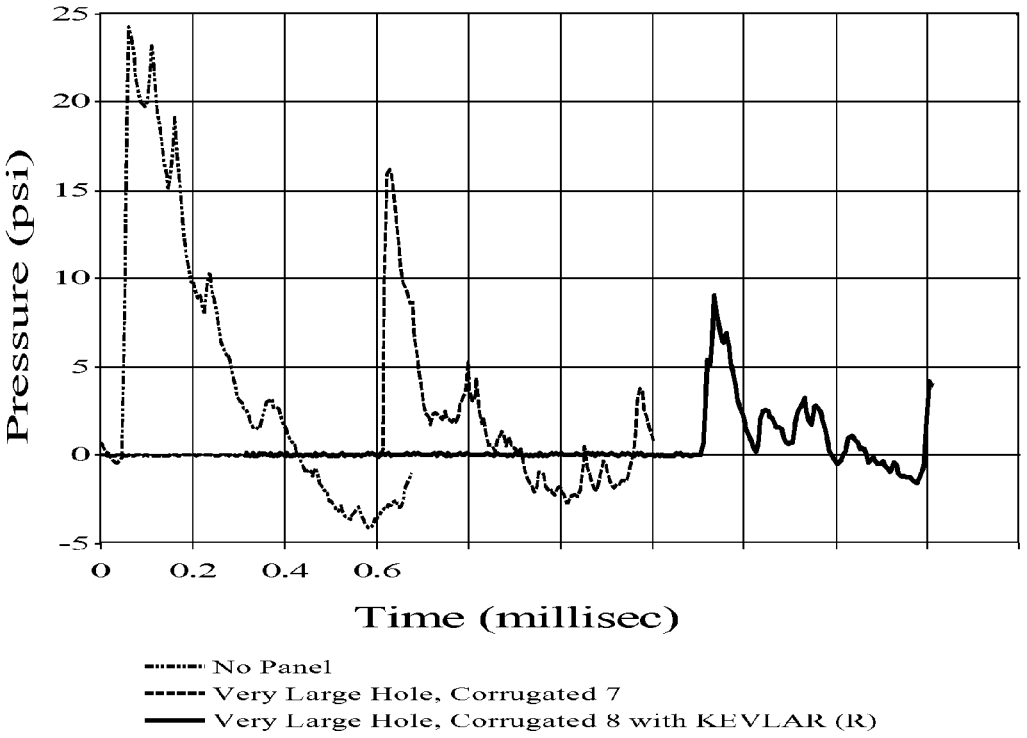

FIG. 11 is a graph of pressure versus time data for two large size port panels tested in Example 3.

Figure 12:
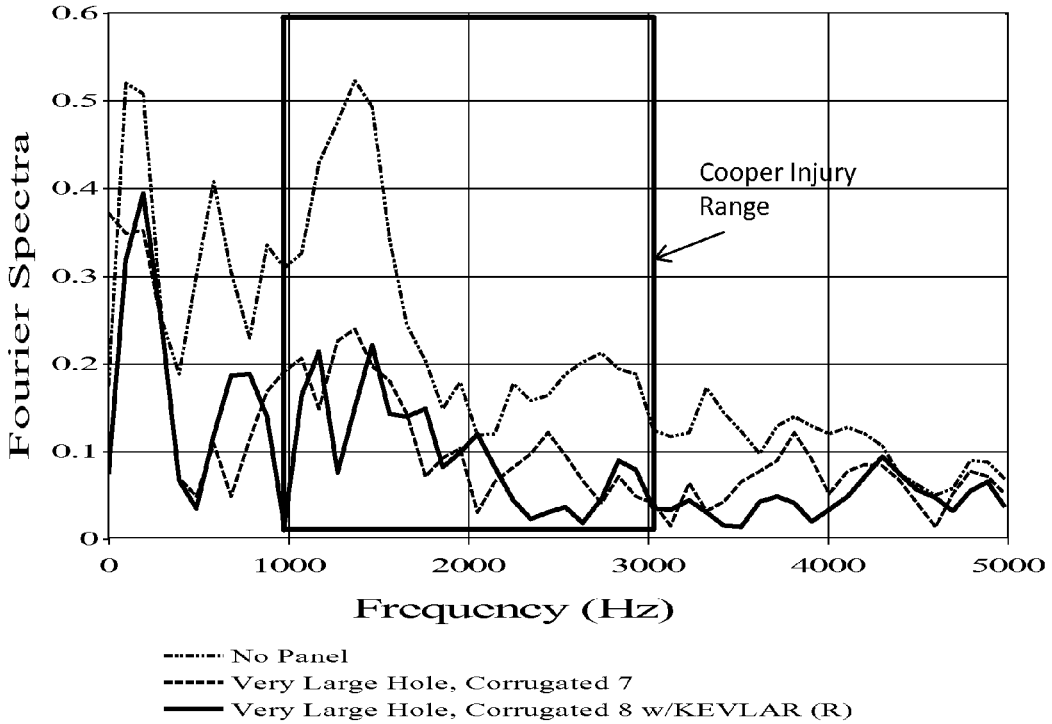

FIG. 12 is a graph of Fourier spectra data versus frequency for two large size port panels tested in Example 3.

DETAILED DESCRIPTION OF THE INVENTION

The invention is described with reference to the Drawing wherein numerals in the written description correspond to like-numbered elements in the several figures. The Drawing discloses a preferred embodiment of the invention and is not intended to limit the generally broad scope of the invention as set forth in the claims. The Drawing is schematic and is not drawn to scale.

The objective of our work was to develop a light-weight panel that limited human exposure to a spectrum of blast wave pressure exposure, particularly the blast wave component in the damaging 1000 to 3000 Hz frequency range. A secondary objective was to deflect and shred projectiles. We accomplished these objectives by combining selected ballistic textile fabrics with ported, corrugated ballistic armor plates. To be fully effective in mitigating injury to humans, a panel must both deflect incoming projectiles and mitigate the transmission of 1000 to 3000 Hz range frequencies in the pressure wave.

We used ported, corrugated ballistic armor plates in vertically generally planar orientation faced with selected ballistic textile fabrics in vertically co-planar orientation. We tested corrugated plate configurations with three different port sizes in combination with a single ply strike surface facing of KEVLAR® ballistic fabric.

Ballistic fabric textiles were selected for their very high strength and sufficient elongation properties under high rate loadings experienced during an explosive blast. The ballistic fabric we used in our tests was DuPont™ KEVLAR® R(XM), 28 by 28 yarns per inch, square weave. Areal density of a single layer ply of this ballistic fabric was 0.025 pounds/square foot. Surprisingly, none of the ballistic fabric layers in the ballistic fabric/ported plate assemblies we tested tore when exposed to direct explosive blast. We attribute this to the ballistic fabric high tensile strength, high Young's modulus and elongation at break of at least 2%, preferably elongation at break of 4% or greater. In addition, we attribute this to a single continuous ballistic fabric layer and the elongated constituent fibers that transmit blast forces and frequencies laterally away. A continuous piece of ballistic fabric provided for transmission of forces through the constituent fibers to allow greater extension of the fabric through the port. This is distinguished from metallic foil layers under the same test conditions reported in co-pending application Ser. No. 13/779,973 for Explosive Blast Shield for Buildings to Alyssa A. Littlestone and Philip J. Dudt, incorporated herein by reference it its entirety. Metal foil ruptured under the same explosive blast test conditions. This is also distinguished from discontinuous strips of fabric that could cover each facing, generally flat lateral surfaces but would not be continuous among the multiple fabric strips to provide for greater elongation of ballistic fabric into any single traversing port and associated physical interaction down to the molecular level of the individual constituent fibers.

Figure 3:
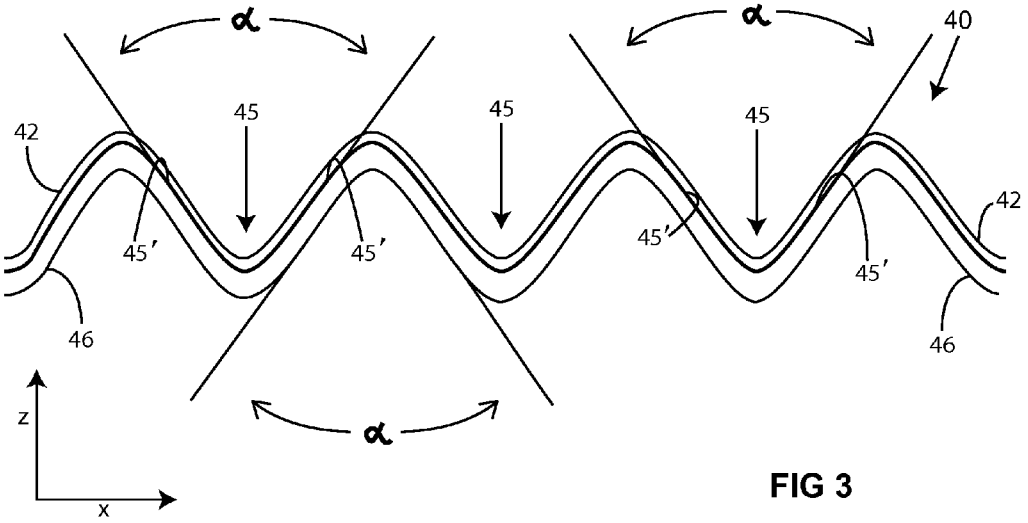
FIG. 3 is an overhead view of the panel along section 3-3 in FIG. 2.

Reference is made to FIG. 1, FIG. 2 and FIG. 3. A generally planar corrugated blast panel 40 comprises a composite of strike surface layer 42 and generally planar corrugated structural armor plate layer 46. The planar orientation is consistent throughout the various figures of the Drawing. Horizontal width plane is indicated by direction arrow x. Horizontal depth plane is indicated by direction arrow z. Vertical height plane is indicated by direction arrow y. Composite panel 40 is mounted in a generally vertically planar orientation on mounting plate 38. The vertically planar orientation positions groves 45 are shown in FIG. 3 to extend vertically from a panel lower end 40*a* to a panel upper end 40*b*. The composite panel 40 is the assembled combination of a ballistic fabric layer 42 and corrugated structural armor plate layer 46. Blast panel 40 is mounted through mounting plate 38 on a concrete vehicle barrier 30 on ground G. There it is fixedly attached to vehicle barrier 30 with steel alloy bolts 32*a* and 32*b* and nuts 34*a* and 34*b*. Concrete vehicle barrier 30 also includes steel reinforcement bars (not shown). Vehicle barrier 30 may also be immobilized with steel reinforcement bars 36*a*, 36*b* driven into the ground G.

Alternative mountings of the blast panel are contemplated. The blast panel is shown elevated on a Jersey type concrete vehicle barrier so that a congregation area, a building window or other place people may assemble is shielded as much as possible from direct view of a blast pressure wave. The positioning of blast panel 40 is selected to protect people and assets from direct impact in the area 48 behind the panel. A blast shield comprises the combination of blast panel 40 with vehicle barrier 30 and any ancillary mounting hardware.

Alternative mountings of the blast panel extend utility as a blast shield. The blast panel may be used to shield portions of buildings. For example, the blast panel may be mounted to shield windows and doors. This can be accomplished in several ways. The blast panel may be mounted as a window or door shutter that is opened and closed as desired. The blast panel may be integrally mounted as part of a balcony so that it shields an elevated window or door from direct street view. Architectural panels comprising the panel of the invention may be attached to the building frame and positioned as an addition to an exterior surface on portions of static structures. In another mounting the panel is attached to a motor vehicle door, side panel or floor panel to protect passengers.

Corrugated blast panel 40 comprises adjacent abutting layers including a ballistic fabric strike layer 42 and a corrugated structural armor plate layer 46. A continuous fabric strike layer 42 is held in contact on the surface of corrugated structural armor layer 46 by various attachment means. In the Example, the fabric was held in place by a frame 47. In the alternative or in addition, the fabric may be held in abutting orientation by means of an adhesive such as polyurea, polyurethane or mixture thereof. The adhesive may be applied to the corrugated structural plate in discontinuous spots or in a very thin coating. In either in spots or in a coating, the adhesive thickness at any point is generally in an adhesive amount in the order of 0.001 to 0.002 inches thick. The method of the invention relies on an abutting relationship between the two layers. The method of the invention functions in combination with an adhesive if the adhesive is applied in an adhesive thickness. Two layers with only an effective adhesive amount between them is defined herein as equivalent to abutting. In the alternative, the fabric may be held in place against the corrugated armor plate with fasteners such as clips, snaps, fabric grippers, hook-and-loop fasteners and the like. The mechanism of the invention relies on explosive wave extension of ballistic fabric into and through the ports. The mechanism makes use of the elongation to break of the fibers comprising the ballistic fabric. Adhesives and fasteners that have the strength to significantly resist fabric extension and elongation at blast pressure forces impair the mechanism and are specifically excluded from the invention.

Strike layer 42 comprises a single continuous ply or multiple continuous plies of ballistic fabric. The terms ply and layer are used interchangeably. It was found experimentally that a ballistic fabric layer having uniform areal density of 0.02 lb./ft$^2$ (pounds per square foot) or greater reduced the amplitude of blast frequencies in the 1000 to 3000 Hz range. A preferred ballistic fabric areal density range of 0.02 to 0.06 lb./ft$^2$ (pounds per square foot) was found to produce advantageous amplitude reductions in the critical 1000 to 3000 Hz frequency range.

Areal density is a term used in the ballistic armor arts and defined in MIL-STD-662 Department of Defense Test Method Standard $V_{50}$ Ballistic Test for Armor, Dec. 18, 1997, incorporated herein by reference. Areal density is a measure of the weight of armor material per unit area. It is expressed in pounds per square foot or kilograms per square meter of armor surface area. Areal density can be thought of as the amount of armor that a potential penetrator will encounter immediately on contacting the target surface. The terms surface density and superficial density are also used for the same areal density measurement. This Military Standard (MIL STD) also specifies the ballistic resistance test for ballistic fabrics.

Fibers used to form ballistic fabrics resistant to penetration and deformation are made of high strength, synthetic polymer that is difficult to rupture. These fiber materials have densities in the range of 0.03 lb./in$^3$ to 0.06 lb./in$^3$ (pounds per cubic inch). Suitable materials include a number of commercially available synthetic fiber materials. Such synthetic fibers include aramid polymers, polyaramid polymers (e.g. KEVLAR®), high density polyethylene polymers (e.g. SPECTRA®) and polypropylene polymers (e.g. TEGRIS®). Natural fibers can be used for ballistic fabric. All of these fibers are used in woven ballistic fabric. Greater blast protection is achieved with the addition of layers of unidirectional rovings and plies. Also, tightly woven cloth with more crossover points causes increased mitigation of the blast wave due to internal reflections. The invention relies on explosive wave extension of ballistic fabric into and through the ports. The mechanism also includes elongation to break of the fibers comprising the ballistic fabric.

Ballistic fabrics having resistance to penetration and deformation are made of high strength, flexible fibers that are difficult to rupture. Suitable materials include various commercially available synthetic fibrous materials. Such synthetic fibers include aramid polymers, polyaramid polymers, polyethylene polymers and polypropylene polymers.

Para-aramid fibers are sold under the registered trademarks KEVLAR®, TECHNORA® and TWARON®. Meta-aramid fibers are sold under the registered trademarks NOMEX®, TEJINCONEX®, NESTAR® and X-FIPER®. Polypropylene fibers are sold under the registered trade mark TEGRIS®. Preferred ballistic fibers are made of super-fiber materials such as ultra-high molecular weight polyethylene sold under the registered trademarks DYNEEMA® and SPECTRA®. Natural silk fibers include silk worm silk and spider silk.

A preferred material of construction is an aramid polymer filament fiber, particularly para-aramid polymer, sold under the registered trade mark KEVLAR® by du Pont de Nemours of Wilmington, Del. KEVLAR® particularly useful for ballistic properties is sold under the name KEVLAR® 29, KEVLAR® 129, KEVLAR® R(KM) Plus and KEVLAR® R(XM). Another preferred ballistic fabric is made of synthetic polymer filament fiber sold under the trade name DYNEEMA® by DSM Company. We selected KEVLAR® R(XM) fabric for use in the Example based on reported physical properties. Those physical properties are reported in Table 1.

TABLE 1

Examples of suitable materials for the ballistic fabric

| | tensile strength, pounds/inch$^2$ | Young's modulus, pounds/inch$^2$ | density, pounds/inch$^3$ | Elongation at break |
|---|---|---|---|---|
| KEVLAR ® 29 yarn | $420 \times 10^3$ | $10.2 \times 10^6$ | 0.052 | 3.6%-4% |
| KEVLAR ® 49 yarn | $420 \times 10^3$ | $18.5 \times 10^6$ | 0.052 | 2.4%-2.8% |
| KEVLAR ® R(KM) Plus yarn | $480 \times 10^3$ | $9.1 \times 10^6$ | 0.047 | |
| DYNEEMA ® filament | $580 \times 10^3$ | $16.0 \times 10^6$ | 0.035 | 3%-4% |
| Nylon ® 6 filament | $117 \times 10^3$ | $0.7 \times 10^6$ | 0.041 | 60% |
| Silk Filament | $45 \times 10^3$ to $83 \times 10^3$ | $1.98 \times 10^6$ | 0.045 to 0.049 | Silk worm 10%-26% Spider 38.7% |

Ballistic fabrics of the invention woven from yarns of natural and synthetic yarns or filaments have physical properties including:

(i.) a tensile strength of 45,000 lb./in$^2$ or greater, (ii.) a Young's modulus of 700,000 lb./in$^2$ or greater.

These natural and synthetic based ballistic fabrics are placed in abutting contact with a structural armor plate layer in an amount to provide a uniform areal density of 0.02 lb./ft$^2$ to 0.06 lb./ft$^2$.

It is desirable that the ballistic fabric have:

(iii.) an elongation at break of at least 2%.

The preferred elongation at break is 4% or greater. In order to effectively utilize the elongation at break physical property of the ballistic fabric, the fabric should be used in a continuous sheet. This provides for greater extension of fabric through the ports.

Tensile strength quantifies the resistance of a material to breaking. It is the measure of the maximum tension that the material can withstand from a stretching load without rupture. Tensile strength is measured according to test ASTM C1557-14 Standard Test Method For Tensile Strength and Young's Modulus Of Fibers. Young's modulus is a measure of the stiffness of an elastic material and is particularly used to quantify the stiffness of similar materials relative to each other. Young's modulus is defined as the stress divided by the linear strain applied, along the same axis. Young's modulus is also known as the modulus of elasticity. Young's modulus is determined experimentally from the slope of a stress-strain curve constructed from tensile test measurements. Elongation at break of woven textile fabrics is measured by ASTM P5035 Breaking Strength and Elongation of Textile Fabrics.

Structural armor plate layer 46 comprises a ballistic armor plate having a minimum Young's modulus of 300,000 psi and a Poisson's ratio between 0.2 and 0.35. These physical properties are achieved with a 0.04-inch to 1-inch thick layer of a ballistic armor plate of a material such as surface hardened steel, titanium armor, alumina-based ceramic, glass reinforced plastic, molded nylon and the like. Two armor thicknesses have been identified for two distinct utilities. The ballistic armor plate thickness demonstrated in the Example is 0.04-inch to 0.075-inch thick. The other ballistic armor plate thickness is 0.1-inch to 1-inch thick. Structural armor plate layer 46 has the physical characteristics of rolled homogeneous armor such as that produced to U.S. Military Specification MIL-A 12560 and the like. Examples of steel include high carbon content modified steel such as American Iron and Steel Institute (AISI) grade 4340 (Ni—Cr—Mo) steel or 4130 (Cr—Mo) steel. The steel may also be U.S. Military Specification MIL-A 46100 or MIL-A 12560 ballistic armor. Another steel is HY-130 (Ni—Cr—Mn—Mo). In the co-pending application we used a naval steel plate commercially identified as HY-100(Ni, Cr, Mo, Mn). HY-100 has a Young's modulus of 30 million psi and a Poisson's ratio of 0.280. The thickness of steel plate is 0.25 inches or more, preferable 0.25 inches to 5 inches. A steel plate thickness of 0.5 inch to 4 inches has been found to be effective and practical for the intended use. In the Example we used a low alloy 5082 aluminum plate. Aluminum armor plate of various thicknesses, particularly in thicknesses of 0.04-inch to 1-inch, are useful for the invention.

A suitable titanium armor is titanium alloy Ti-6Al-4V. These ballistic armors are useful in thicknesses of 0.04-inch to 1-inch.

FIG. 2 shows a frontal view of the panel along section 2-2 in FIG. 1. The structural armor plate layer 46 is not seen in the frontal view as it is completely covered with a single ply of ballistic fabric 42. The ballistic fabric 42 is held in abutting relationship with armor plate layer 46 by frame 47. Frame 47 does not impede ballistic fabric stretching at explosive blast wave pressures.

FIG. 3 is an overhead view of panel 40 along section 3-3 in FIG. 2. Grooves 45 are also known in the art as flutes. Grooves are generally V-shaped as indicated by included intersection angle $\alpha$ between each pair of facing, generally flat lateral surfaces 45'.

Figure 4:
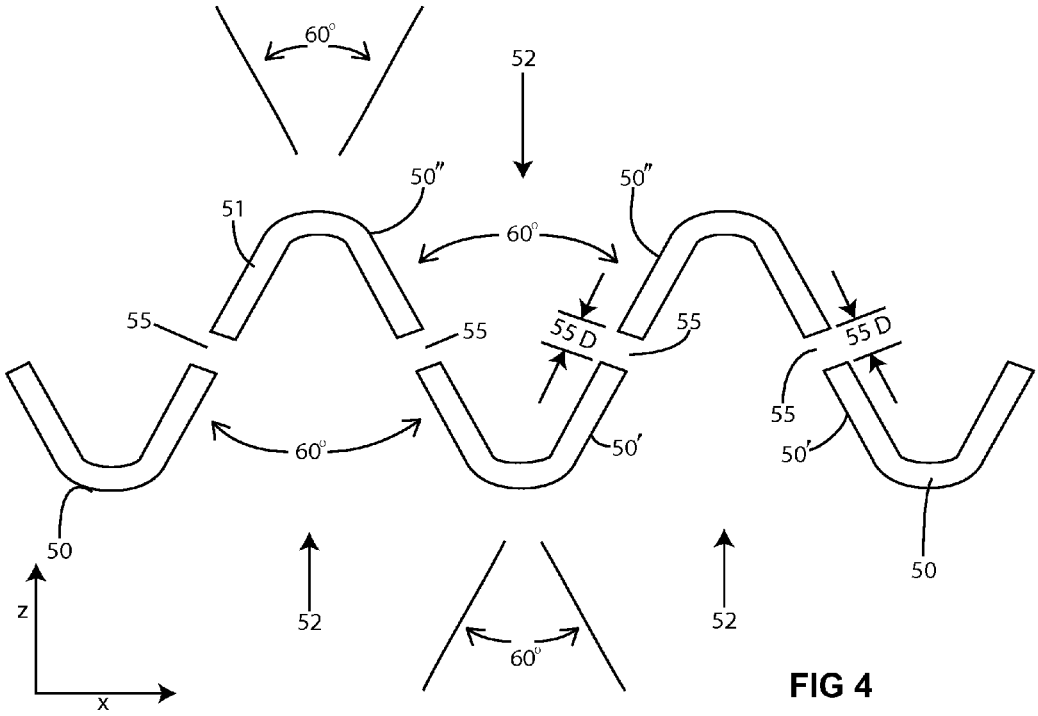
FIG. 4 is a cross-sectional view of a 60° V-groove corrugation structural armor plate, the section taken through ports to show them.

FIG. 4 is a sectional view of a V-groove corrugated structural armor plate layer 50, similar to the overhead view of armor plate layer 40 shown in FIG. 3. In FIG. 4, the corrugated armor plate layer 50 is sectioned to show traversing ports 55 of diameter 55D. Grooves 52 are generally V-shaped as indicated by included intersection angle of magnitude 60° between each pair of facing, generally flat lateral surfaces 50' and 50". Armor plate face 51 is indicated.

FIG. 5 is a sectional view of a V-groove corrugated structural armor plate layer 70, similar to the overhead view of armor plate layer 50 shown in FIG. 4. In FIG. 5, the corrugated armor plate layer 70 is sectioned to show traversing ports 75 of diameter 75D. Grooves 72 are generally V-shaped as indicated by angle of magnitude 90° between each pair of facing, generally flat lateral surfaces 70' and 70". Dotted line DL indicates one port 75 shown in FIG. 5*a*. Armor plate face 71 is indicated.

FIG. 5*a* is a magnified view of port 75 enclosed in dotted line DL shown in FIG. 5. Armor plate layer 70 is traversed by port 75 having a circular diameter 75D. Port 75 is defined by circumferential port side wall surface 74. Sharp edge 72' is at the intersection of port side wall surface 74 and flat, lateral surface 70'. On the other armor layer plate layer 70 surface, sharp edge 72" is at the intersection of flat lateral surface 70" and port side wall surface 74. Armor plate layer 70 is made of a ballistic armor material having a minimum Young's modulus of 300,000 psi and a Poisson's ratio between 0.2 and 0.35. Accordingly, sharp edges 72' and 72" are capable of shredding many high velocity projectiles.

Circular ports 75 were intentionally formed to produce sharp edges 72' and 72" along the port peripheral circumferences on the armor plate 70 surfaces 70' and 70". Sharp edges 72' and 72" in combination with ballistic properties of armor plate 70 provide projectile shredding when effectively positioned relative to the flight path of an incoming projectile. Effective position is achieved by an included intersection angle $\alpha$ in FIG. 3 in the range of 60° and 90°. This positions port inner walls at angles of about 30° to 45° to the flight path of many incoming projectiles and positions sharp edges 72', 72" for effective projectile shredding.

Traversing ports pass completely through the armor plate layer. Traversing ports have diameters providing sufficient lateral area to allow deformation of the ballistic fabric strike layer through the structural armor plate layer. It has been found experimentally that traversing port diameters of 0.1 inches to 0.5 inches are sufficient to allow elongation of the ballistic fabric strike surface ply into and through structural armor plate layer. We found that one ply of ballistic fabric having an areal density of 0.02 to 0.06 pounds per square foot (lb./ft$^2$) performed well in ports having diameters in the range of 0.1 to 0.5 inch. In order to effectively utilize the elongation at break physical property of the ballistic fabric, the fabric should be used in a continuous sheet. This provides for greater extension of fabric through the ports.

Relatively thinner ballistic fabric layers having relatively lesser areal density should be combined with relatively smaller diameter traversing ports. Excluded from the invention are ports that do not have sufficient diameter to allow deflection of explosively deformed ballistic fabric strike surface layer into them. For example, a plurality of small diameter perforations may provide considerable free area, but not allow elongation of explosively deformed ballistic fabric strike surface layer there through. That is, smaller diameter perforations do not allow the mechanism of the invention to function. The mechanism of the invention provides for a multiplicity of ballistic fabric diaphragms to dissipate blast force by permanently stretching the constituent fibers. The extent of fabric stretching is defined by the force of the blast and physical characteristics of the fabric. Ultimately, if the elongation at break is exceeded, fibers will break and the fabric will rupture. However, the ballistic fabric is continuous over the face of the armor plate layer. Unlike rupture discs, the ballistic fabric is available between ports to stretch toward, into, and through the ports. This provides more than double the area of fabric than for hypothetical individual rupture discs to participate in attenuation of the 1000 to 3000 Hz frequency range attenuation.

Ports are formed by drilling, grinding, chemical machining and the like. Precision is not necessary for the diameters of the traversing ports. Depending on the anticipated threat it may be desirable to provide a number of different diameters, i.e. variation in diameters over the inventive range in the structural armor plate layer 46. Multiple diameters of different magnitude, i.e. variation in diameter 55D, provide further variation in partitioning the blast pressure wave. In a preferred arrangement, traversing ports having diameters of 0.1 to 2 inches are preferred. In another preferred arrangement, traversing ports having diameters of 0.1 to 2 inches, spaced 0.1 to 0.5 inches are preferred. In another preferred arrangement, the ports provide a face surface projectile blockage of lateral port area divided by face surface area of 0.6 to 0.8. The face surface projectile blockage is enhanced by the corrugation of the structural armor plate layer. The blast frequency control panel has a total projectile blockage perpendicular to the generally planar orientation. The total projectile blockage is defined by the 1.00 minus the product of the face surface projectile blockage multiplied by the sine of a half angle of the included intersection angle.

The ports are formed to be sharp-edged. The term sharp-edged is known to those skilled in the art to mean an angle equal to or lesser than 90°. That is the included angle is either a right angle or an acute angle. The term sharp-edged may be further refined to mean a tool, that in combination with the material of construction is capable of cutting the intended work piece. In the present invention, the work piece is the propelled bullet from a military ammunition round comprising a bullet, propellant, primer and cartridge case in a single unit. Material of construction for bullets includes cast lead and lead alloys and jacketed lead and lead alloys. Jackets are made from materials including gilding metal, cupro-nickel, copper alloys, steel and functionally equivalent materials. Armor piercing bullets are made of hard, dense materials including tungsten, tungsten carbide, steel and depleted uranium. Bullets may be externally shaped or internally hollowed out to improve penetration or damage to a specific armor target. Bullets are the work piece that comes in contact with the sharp-edged port tool of the invention.

Ports in combination with the underlying structural armor plate layer modify the blast pressure wave and dampen peak blast wave pressure impacting the targeted populated area 48. The ported structural armor plate layer provides additional dividing and mitigation of the explosive blast wave.

Theory

We were inspired by their observations of explosive blast pressure measurements on diaphragm gauges. An ordinary diaphragm gauge includes a metallic pressure sensing element that elastically deforms under the effect of a pressure difference across the element. A ductile metallic disc is the pressure sensing element mounted over a circular port and exposed to an explosive blast. The ductile metallic diaphragm responds to excess pressure with a dish-shaped deflection, alternately referred to as hemispherical or concave deflection. Explosive blast pressure is read by comparison of the amount of diaphragm deflection with a set of blast pressure-calibrated diaphragms. It is possible to construct a stress-strain curve of a diaphragm material by exposing discs to sequentially increased explosive charges.

We found that a metallic pressure sensing element could be replaced with a continuous sheet of ballistic fabric that dissipated considerable more explosive blast pressure than metallic pressure sensing elements previously investigated. In addition, the amplitude of certain particularly damaging frequencies in the blast frequency spectrum was reduced. Blast pressure dissipation was achieved by selecting circular port diameter and selecting ballistic fabric. Blast pressure dissipation was particularly achieved by providing more than double the surface area of ballistic fabric to interact with the blast wave compared with a simple rupture disc. The ballistic fabric permanently stretched, i.e. elongated, into the ports but did not rupture to form spall during any of the tests. Reversible and irreversible fiber stretching consumed blast energy and altered frequency content of the blast wave, immediately behind the panel.

Thickness of the structural armor plate and circular port diameter are selected in view of the magnitude of the anticipated explosive threat. Armor plate thicknesses at the upper end of the inventive range are paired with more ballistic fabric plies to defeat a larger magnitude explosive threat. Armor plate thicknesses at the lower end of the inventive range are paired with a lesser thickness ballistic fabric ply to defeat an anticipated smaller magnitude explosive threat. Although any of the combinations of materials is effective for the intended purpose, it has been found that armor plate and ballistic fabric pairs are selected based on anticipated threats.

The structural armor plate was corrugated to give the assembled shield enhanced structural stability without adding thickness and hence weight and increasing cost. There are alternative possibilities to form a ported, corrugated armor plate. We realized that sharp edged ports would provide projectile shredding in addition to structural stability.

FIG. 6*a* is a schematic representation of a structural armor plate that will be corrugated. Structural armor plate 140*a* has parameters that define face surface projectile blockage. Structural armor plate face surface 141 is shown. Face surface 141 has a superficial surface area defined by width w multiplied by height h. Circular ports 155 with diameters D are shown as well as axes of rotation 157. Centering line C1 is a locus of points midway between the axes of rotation 157 as show. Each circular port 155 has an area calculated as pi times diameter D divided by 2 and then squared or $\pi(D/2)^2$. The total port area on the face 141 of armor plate 140*a* is the total number of ports times pi times the square of half the diameter. The face surface projectile blockage is the number 1.00 minus the quotient of the sum of lateral port areas divided by the structural armor plate face surface area.

We used face surface projectile blockage, described with reference to FIG. 6*a*, to be characterized by port area. Face surface projectile blockage is unity minus the ratio of port surface area/total blast exposed area. Total blast exposed area is the sum of the face surface area plus the sum of the traversing port lateral areas.

Face Surface Projectile Blockage (FSPB)

$$FSPB = 1 - \frac{N\pi D^2}{4\ (\text{Total Area})}$$

Wherein:

N=number of ports of diameter D

Total Area=total blast wave exposed area, perforated armor plate layer surface area plus $\pi D^2/4$ (exposed blast area)

$\pi$=ratio of circumference to diameter of a circle, (about 3.14).

Face surface projectile blockage is a measure of the blockage of any projectile by the flat structural armor plate perforated with ports. The face surface projectile blockage is enhanced by the corrugation of the armor plate. The collective window for transit of any impacting projectile through the flat structural armor plate is the sum of the free area presented by the flat armor plate, i.e. the sum of the port surface areas. As described below, the collective windows are reduced in magnitude by corrugation as viewed by a projectile approaching from the perpendicular. The amount by which the collective windows are reduced is quantified by the sine of the included intersection half angle of the corrugation. The intersection half angle is half the intersection angle. In FIG. 6e-1 the included intersection angle is angle $\beta$. In FIG. 6e-2 the half angle is angle $\beta$ divided by 2, i.e. $\beta/2$.

Total Projectile Blockage (TPB)

$$TPB = 1 - \frac{\sin(\beta/2)N\pi D^2}{4\ (\text{Total Area})}$$

Wherein:

N=number of ports of diameter D,

Total Area=total blast wave exposed area, perforated armor plate layer surface area plus $\pi D^2/4$ (exposed blast area), $\pi$=ratio of circumference to diameter of a circle, (about 3.14), $\beta/2$=half angle of corrugation included angle.

The result is a total projectile blockage of about 0.7 to 0.9.

FIG. 6b is a schematic cross-sectional view of the same flat structural armor plate 140a before corrugation. Armor plate 140a lies in a horizontal plane indicated by arrow x and has a flat face 141. Work on plate 140a is oriented relative to centering line C1 shown in this orientation as a point. Circular ports 155 are shown. The circular ports 155 have axes of rotation 157 which are parallel to arrow z. Axes of rotation 157 are perpendicular to the plane that flat armor plate 140 lies in. Centering line C1 shown in this orientation as a point, lies half way between the two axes. Pairs of facing, generally flat lateral surfaces 140' are shown. Pairs of facing, generally flat lateral surfaces 140" are shown.

In FIG. 6c, armor plate 140b is shown on die block 150. Punch 152 is positioned above and aligned with die block 150. Die block 150 has mold surfaces 150' which are at angle $\alpha'$ parallel to punch surfaces 152' on punch 152. Viewed together, punch surfaces 152' are V-shaped and flat. Punch 152 is attached to a mechanical press (not shown) capable of moving punch 152 in the direction indicated by direction arrow 154, to mate with die block 152 with sufficient force to bend armor plate 140b. Die block 150 mold surfaces 150' are also V-shaped and flat.

In FIG. 6d, armor plate 140c is shown on die block 150. Punch 152 has closed with die block 150. Centering line C1 is shown as a point. Punch surfaces 152' have closed with perpendicular mold surfaces 150', separated only by the thickness of armor plate 140c. As a result a V-shaped groove has been formed in armor plate 140c. The operation is repeated sequentially across the surface of armor plate 140c to produce a series of straight, parallel, alternating ridges and V-grooves known as corrugation. Facing flat lateral surfaces have an included intersection angle $\alpha'$. In FIG. 4 the included intersection angle is 60°. In FIG. 5 the included intersection angle is 90°. The half angle of included intersection angle $\alpha'$ is simply angle $\alpha'$ divided by 2.

The parameters of total projectile blockage perpendicular to the generally planar orientation are shown in FIG. 6e-1 and FIG. 6e-2. In FIG. 6e-1 the armor plate 140a in FIG. 6a has been corrugated with an included intersection angle $\beta$. In this orientation, centering line C1 is viewed as a point on face 141. Centering line C1, shown as a point in this orientation, lies half way between the two ports 155. As shown in FIG. 6a, each port in FIG. 6e-1 has a diameter D. Projectiles P are approaching armor plate 140a as indicated by parallel direction arrows $p_1$, $p_2$ and $p_3$ indicating the flight direction of projectiles P. The flight direction of projectiles P is perpendicular to a generally horizontal orientation $O_1$ of the armor plate. That is, $O_1$ is parallel with the x axis and perpendicular to the projectile approach direction arrows $p_1$, $p_2$ and $p_3$.

FIG. 6e-2 shows how total projectile blockage perpendicular to the generally planar orientation of the armor plate is quantified. The area available for any projectile P' to pass through a port is reduced from the component of port diameter D that is in the x-plane (D sine ($\beta/2$)). The diameter of that port is D multiplied by the sine of the included intersection half angle ($\beta/2$). That reduced port area is quantified by the face surface projectile blockage multiplied by the sine of the included intersection half angle.

Method of the Invention

Viewed in sequence, FIG. 6b, FIG. 6c and FIG. 6d show a schematic sequence of structural armor plate corrugation forming events. In particular they show the method of the invention.

A structural armor plate is perforated with ports, aligned in straight, parallel, regularly spaced rows. The layout and alignment of the ports is made in anticipation of the corrugation step that follows so that the ports are positioned symmetrically on pairs of facing, generally flat lateral surfaces on the corrugated plate.

The ports are formed on a flat structural armor plate prior to corrugation. This assures that the circular port axes are perpendicular to the surface of the flat structural armor plate layer. The circular ports have diameters of 0.1 to 0.5 inches.

The ported plates are next corrugated by bending the structural armor plate to form straight, parallel V-shaped grooves at regular intervals. Each V-shaped groove includes a pair of straight, parallel rows of ports. It is essential that the grooves be V-shaped so that the ports remain on a flat surface. Also, bending is an amount to causes the axes of pairs of ports to intersect at a 60° to 90° angle. This causes port axes to lie at the half angle of 30° to 45° to the normal flight path of impacting projectiles. As a result, projectiles are shredded on the sharp armor plate edges of the ports by combined action of the angle of incidence on sharp armor edges and the projectile momentum and material of construction.

The corrugated ballistic armor plate is enhanced with a strike surface layer of a ballistic fabric layer. The ballistic fabric is characterized in:

(i.) a tensile strength of 45,000 lb./in$^2$ or greater, (ii.) a Young's modulus of 700,000 lb./in$^2$ or greater, and (iii.) an elongation at break of 2% or greater.

We found that attaching the ballistic fabric to the corrugated armor plate with a circumferential frame allowed full advantage to be taken of the stretching and elongation at break properties of the entire continuous piece of ballistic fabric. The greatest advantage is achieved from the ballistic fabric material if relatively greater lengths of fabric are available to elongate into and through the ports. The more fabric fibers extend, the greater the amount of explosive blast energy expended. Likewise, the more fabric fibers are activated, the greater the amplitude of damaging blast frequencies is diminished.

The invention is shown by way of Example.

EXAMPLE

Test Set-Up and Procedure

The ballistic fabric ply we used in our tests was DuPont™ KEVLAR® R(XM), 28 by 28 yarns per inch, square weave. Areal density of a single ply of this ballistic fabric was 0.025 pounds/square foot.

The armor we used was nominally 0.04-inch to 0.075-inch thick low-alloy 5082 aluminum sheet. We purchased three thicknesses of 5082 aluminum sheet. The small port sheets were nominally 0.04-inch thick, stamped with nominally 0.094-inch ports, closely spaced. The medium-port sheets were nominally 0.05-inch thick, stamped with nominally 0.25-inch ports, spaced 0.5-inch apart. The large-port sheets were nominally 0.075-inch thick, stamped with nominally 0.5-inch ports, spaced 1-inch to 1.25-inch apart. We cut the sheets into test panels, with attention to maintaining straight rows of ports in the corrugation step that followed.

We applied V-groove corrugation to the cut test panels. We aligned the medium-port and large-port panels so that all ports lined up along each V-groove at regular intervals along each pair of facing flat lateral surfaces forming the V-groove. The small-port panels were aligned before corrugation so that a uniformly spaced row of ports was positioned along each V-groove ridge as well as at regular intervals along each pair of facing flat lateral surfaces forming the V-groove. The corrugations formed a series of straight, parallel, alternating ridges and V-groves across the sheets. Each V-groove had a pair of facing, generally flat lateral surfaces with an included (intersection) angle. The corrugated test panels were made up with included angles of 60° and 90°.

We faced the test panels with ballistic fabric consisting of DuPont™ KEVLAR® R(XM) (0.025 pounds/square foot). The ballistic fabric was held in place by the support frame fastened around each test panel. The support frames allowed test panels a nominal planar exposure of 11-inches by 11-inches. For each test, four framed test panels were supported 5-feet off the ground on fixtures positioned at right angles around a cylindrical explosive charge. A PCB Model 137A23 Quartz ICP® pressure sensor from the PCB Group Inc. company was positioned 8 inches behind each test panel. That was 36 inches from the $X_1$-pound pentolite charge.

For the Example we used a charge of military grade pentolite comprising a 50:50 mixture of pentaerythritol tetra nitrate (PETN) and 2,4,6-trinitrotoluene (TNT). Military grade pentolite has a detonation velocity of 1.65 grams/cubic centimeter. For all examples, we used a pentolite charge weighting $X_1$-pounds. This weight of pentolite explosive charge was selected, from experience to be survivable, yet capable of causing lung and pulmonary brain injury. The explosive charge was a cylinder of pentolite with a height-to-diameter aspect ratio of 1:1. The cylindrical shape gave equal exposure to each of the four test panels spaced 28 inches (2.33 feet) from each panel.

A pentolite charge was detonated and blast pressure recorded. Peak blast pressure measured adjacent the charge was 38 psi. Peak blast pressure measured 36 inches from the charge behind an empty panel mounting frame was 24 psi.

Example 1

Small-Port Panels

Aluminum sheet comprising low-alloy 5082 aluminum having a thickness of 0.04 inches was purchased. The sheet received had 0.094-inch diameter circular ports regularly spaced in a staggered pattern. Port spacing was 0.16 inches and 0.19 inches depending on the direction measured in the staggered pattern. The circular ports had been punched with circular axes perpendicular to the surface of the aluminum sheet. This produced a sharp edge between the sheet surface and the circular port wall. The face surface projectile blockage of the sheet before corrugation was 0.23.

We cut the sheets into test panels, with attention to maintaining straight rows of ports in the corrugation step that followed. the port pattern after corrugation. Three small-port panels were corrugated in our metal shop to produce three corrugated panels. One panel was corrugated with pairs of 10.5-inch wide flat lateral surfaces having an included angle. Two panels with 11.5 corrugations were fabricated having an included angle reported in Table 2. One panel was not corrugated.

The four small port panels were prepared for testing by placing them in mounting frames. One panel with 11.5 corrugations was faced with a single ply of DuPont™ KEVLAR®R(XM) ballistic fabric having 28 by 28 yarns per inch, square weave. The four panels included: a flat panel, two corrugated panels and one corrugated panel faced with KEVLAR® R(XM) ballistic fabric. The frame around the edge of the panel held the ballistic fabric in contact with the metal armor. The framed panels were mounted on test stands with the ballistic fabric facing the $X_1$-pound pentolite charge spaced 28 inches away.

The pentolite charge was detonated and the blast pressure wave was recorded on PCB Model 137A23 Quartz ICP® pressure sensors mounted 8 inches behind each panel.

The pressure measurement for the flat, ported panel was 10.6 psi. The pressure measurement for the two corrugated, ported panels was about 15 psi. The pressure measurement for the corrugated, ported panels faced with ballistic fabric 6.7 psi. These pressure measurements along with the measurement without a panel are reported in FIG. 7.

TABLE 2

Small Port Panel Data

| Port pattern | Staggered | Staggered | Staggered |
|---|---|---|---|
| Number of Corrugations | 0 | 10.5 | 11.5 |
| Included Angle | 180° | 63° | 54° |
| Height | | 1 inch | 1 inch |
| Plate thickness | 0.04 inches | 0.04 inches | 0.04 inches |
| Port diameter | 0.094 inches | 0.094 inches | 0.094 inches |
| Center-to-center distance 1 | 0.16 inches | 0.16 inches | 0.16 inches |
| Center-to-center distance 2 | 0.19 inches | 0.19 inches | 0.19 inches |
| Length of panel | 12 inches | 12.5 inches | 12.5 inches |
| Length of corrugations | 12 inches | 21.6 inches | 23.7 inches |

TABLE 2-continued

| Small Port Panel Data | | | |
|---|---|---|---|
| Port pattern | Staggered | Staggered | Staggered |
| Face surface projectile blockage | 0.23 | 0.39 | 0.42 |
| Total projectile blockage | | 0.68 | 0.74 |

The recorded pressure wave measured at the pressure probe was analyzed to produce a Fourier spectra over a 6 milli-second time window. The Fourier spectra for the five cases are reported in FIG. 8. The Cooper Injury Range, 1000 to 3000 Hz frequency, is the critical brain and lung tissue damaging frequency component of the blast spectrum. The 6 milli-second time window is sufficient length to record both directly transmitted and diffracted pressure waves. The ballistic fabric covered panel was the only one of the four panels to significantly reduce blast pressure in the critical 1000 to 3000 Hz frequency range.

Example 2

Medium-Port Panels

Aluminum sheet comprising low-alloy 5082 aluminum having a thickness of 0.05 inches was purchased. The sheet received had 0.25-inch diameter circular ports regularly spaced in uniform straight rows. Port spacing was 0.5 inches. The circular ports had been punched with circular axes perpendicular to the surface of the aluminum sheet. This produced a sharp edge between the sheet surface and the circular port wall. The face surface projectile blockage of the sheet before corrugation was 0.2.

We cut the sheets into test panels, with attention to maintaining straight rows of ports in the corrugation step that followed. Six medium-port panels were corrugated in our metal shop to produce six corrugated panels. Three panels had 10.5 corrugations and three panels had 12.5 corrugations. One panel was not corrugated.

The medium port panels were prepared for testing by placing them in mounting frames. One panel with 10.5 corrugations and one panel with 12.5 corrugations were with a single ply of DuPont™ KEVLAR® R(XM) ballistic fabric having 28 by 28 yarns per inch, square weave. The panels included a flat panel, two corrugated panels, two corrugated panel faced with KEVLAR® ballistic fabric and a two layer ported panel combination were framed. For the two ballistic fabric faced panels, the frame around the edge of the panel held the ballistic fabric in contact with the metal armor. The framed panels were mounted on test stands with the ballistic fabric facing the $X_1$-pound pentolite charge spaced 28 inches away.

The pentolite charge was detonated and the blast pressure wave was recorded on PCB Model 137A23 Quartz ICP® pressure sensors mounted 8 inches behind each panel.

The pressure measurement for the flat, ported panel was 13.0 psi. The pressure measurement for the two corrugated, ported panels was 15.5 psi for the 10.5-corrugation panel and 16.4 psi for the 12.5-corrugation panel. The pressure measurement for the two corrugated, ported panels was 15.5 psi for the 10.5-corrugation panel and 16.4 psi for the 12.5-corrugation panel. The pressure measurement for the stacked two-layer corrugated, ported panels, the 10.5-corrugation panel in front of the 12.5-corrugation panel, was 10.8 psi.

The pressure measurement for the 12.5-corrugation, ported panels faced with ballistic fabric was 5.6 psi. The pressure measurement for the 10.5-corrugation, ported panels faced with ballistic fabric was 3.87 psi. These pressure measurements along with the measurement without a panel are reported in FIG. 9.

TABLE 3

| Medium Port Panel Data | | | |
|---|---|---|---|
| Port pattern | Straight row, uniform | Straight row, uniform | Straight row, uniform |
| Number of Corrugations | 0 | 10.5 | 12.5 |
| Included Angle | 180° | 58° | 45° |
| Height | | 0.9 inch | 0.9 inch |
| Plate thickness | 0.05 inches | 0.05 inches | 0.05 inches |
| Port diameter | 0.25 inches | 0.25 inches | 0.25 inches |
| Center-to-center distance | 0.5 inches | 0.5 inches | 0.5 inches |
| Length of panel | 12 inches | 12.25 inches | 12.25 inches |
| Length of corrugations | 12 inches | 21.0 inches | 21.9 inches |
| Face surface projectile blockage | 0.2 | 0.33 | 0.4 |
| Total projectile blockage perpendicular to the generally planar orientation | | 0.84 | 0.85 |

The recorded pressure wave measured at the pressure probe was analyzed to produce Fourier spectra over a 6 milli-second time window. The Fourier spectra for the six cases are reported in FIG. 10. The Cooper Injury Range, 1000 to 3000 Hz frequency, is the critical brain and lung tissue damaging component of the blast spectrum. The 6 milli-second time window is sufficient length to record both directly transmitted and diffracted pressure waves. The ballistic fabric covered panel was the only one of the four panels to significantly reduce blast pressure in the critical 1000 to 3000 Hz frequency range.

Example 3

Large-Port Panels

Aluminum sheet comprising low-alloy 5082 aluminum having a thickness of 0.075 inches was purchased. The sheet received had 0.5-inch diameter circular ports regularly spaced in uniform straight rows. The circular ports had been punched with circular axes perpendicular to the surface of the aluminum sheet. This produced a sharp edge between the sheet surface and the circular port wall. The ports were arranged in straight rows with a center-to-center distance of 1.25 inches for each row and a center-to-center distance of 1 inches between rows for the panel with 7 corrugations. There was closer spacing of 1 inches within the rows and 0.75 inches between rows for the panel with 8 corrugations. The panel with 7 corrugations had a face surface projectile blockage of 0.23. The face surface projectile blockage of the sheet before corrugation was 0.35.

The panel with 8 corrugations was tested with a layer of DuPont™ KEVLAR® R(XM), 28 by 28 yarns per inch, square weave, ballistic fiber held in place against the strike surface. The blockage without the KEVLAR® R(XM) ballistic fiber was 0.47.

The large port panels were prepared for testing by placing them in mounting frames. One panel had 7 corrugations and one panel had 8 corrugations with a single layer of DuPont™ KEVLAR® R(XM) ballistic fabric having 28 by 28 yarns per inch, square weave. A flat panel with 0.5 inch diameter ports and no corrugation was also mounted in a frame. The framed panels were mounted on test stands with the ballistic fabric facing the $X_1$-pound pentolite charge spaced 28 inches away.

The pentolite charge was detonated and the blast pressure wave was recorded on PCB Model 137A23 Quartz ICP® pressure sensors mounted 8 inches behind each panel.

The transmitted pressure was fairly high at 16.1 psi which suggested that at an equivalent blockage, large ports permitted greater pressure transmission. Transmitted pressure for the small-port flat panel was 10.6 psi. Transmitted pressure for the medium-port flat panel was 13.0 psi at nearly equivalent blockages. This assumes a direct comparison between flat and corrugated configurations.

The panel with 8 corrugations was tested with KEVLAR® R(XM) ballistic fabric and the transmitted pressure was 9.0 psi. This is a reduction from the screen with seven corrugations without ballistic fabric, though the design is somewhat different with larger perforated area with a face surface projectile face surface projectile blockage of 0.35 beneath the KEVLAR® R(XM) ballistic fabric. A graph containing the transmitted pressure profiles for both configurations with large ports is shown in FIG. 11.

Both panels of Example 3 were significant deformed by the $X_1$-pound pentolite charge. This suggests that the ballistic fiber-port size-corrugated armor plate thickness combination can be optimized.

TABLE 4

Large Port Panel Data

| Port pattern | Straight row, uniform | Straight row, uniform |
|---|---|---|
| Number of Corrugations | 7 | 8 |
| Included Angle | 92° | 94° |
| Height | 1 inch | 1 inch |
| Plate thickness | 0.075 inches | 0.075 inches |
| Port diameter | 0.50 inches | 0.50 inches |
| Center-to-center distance, 1 inch | 1.25 inches | 1.00 inches |
| Center-to-center distance, 2 inch | 1.00 inches | 0.75 inches |
| Length of panel | 12 inches | 12 inches |
| Length of corrugations | 15.8 inches | 18.0 inches |
| Face surface projectile blockage | 0.23 | 0.35 |
| Total projectile blockage perpendicular to the generally planar orientation | 0.44 | 0.47 |

The pressure wave recorded at the pressure probe was analyzed to produce Fourier spectra over a 6 milli-second time window. The Fourier spectra for the three panel cases are reported in FIG. 12. The Cooper Injury Range 1000 to 3000 Hz frequency is the critical brain and lung tissue damaging frequency range. The 6 milli-second time window is sufficient length to record both directly transmitted and diffracted pressure waves. The addition of KEVLAR® R(XM) ballistic fabric to the 8-port corrugated panel gave similar performance to the 7-port corrugated panel. However the KEVLAR® R(XM) ballistic fiber panel reduced the 1000 Hz blast frequency content to about 0.02, a very low measurement.

The scientific literature reports that initiation of lung damage for one-time blast exposure is a function of peak pressure and duration (impulse). We have not found a definitive determination of the mechanism for traumatic brain injury in the relevant scientific literature. It is reported that blast exposure sufficient to cause brain injury may be less than for lung damage.

Results

The results obtained from these tests include pressure profiles from gauges placed both behind each panel and at a distance in the free field. We also visually inspected test specimens and took photographs. From the pressure profile we calculated impulse, Fourier spectrum, and identified maximum pressure. Fourier spectrum provided a graphical view of the frequency distribution in the blast wave spectrum. Impulse was calculated because it has been identified as a blunt impact brain injury mechanism. In addition to peak pressure, impulse is a measurement of blast exposure.

We inspected the panels after testing. We noted that none of the KEVLAR® ballistic fabric test samples tore during blast extension into the ports. We noticed considerable pull out around the edges of the ports as the ballistic fabric sprang back after extension into the ports. We noted an imprint of the ports was left on each KEVLAR® ballistic fabric ply. The individual responses of the panels were recorded as shown in FIGS. 7, 8, 9, 10, 11, and 12.

Summary of Results

Smaller, closely-spaced ports, for a given blockage is more effective with corrugated panels. A KEVLAR® ballistic fabric ply facing the corrugated metal armor produced a significant benefit in all cases. However, there was a greater benefit with larger ports. This is probably due to the fact that there is increased opportunity for the KEVLAR® ballistic fabric ply to extend into the ports, absorbing more energy. Ports cooperate with the ballistic fabric. Without the ports, fabric extension would be limited. With ports too small, fabric extension would also be limited. With ports too large, the fabric fibers would not interact individually, i.e. extend to break, and fully participate in frequency mitigation.

The foregoing discussion discloses and describes embodiments of the invention by way of example. An armor plate layer with two series of corrugations orthogonal to each other is one equivalent. One skilled in the art will readily recognize from this discussion, that various changes, modifications and variations can be made therein without departing from the spirit and scope of the invention as defined in the following claims.

What is claimed is:

1. A blast frequency control panel consisting essentially of two abutting layers comprising:

(a.) a corrugated structural armor plate layer having a generally planar orientation and a face surface: and (i.) a series of straight, parallel, alternating ridges and V-grooves, each V-groove having a pair of facing, generally flat lateral surfaces with an included intersection angle of 60° to 90° there between, and (ii.) regularly spaced sharp-edged ports traversing the generally flat lateral surfaces, each traversing port having sufficiently large lateral area, measured at the general flat lateral surface it traverses, to allow elongation of a ballistic fabric into the port, and (iii.) the corrugated structural armor plate layer having a face surface projectile blockage of 0.6 to 0.8, the face surface projectile blockage defined by the number 1.00 minus a quotient of total traversing port lateral area divided by face surface area plus total traversing port lateral area;

(b.) a strike surface layer comprising the ballistic fabric comprising a continuous ballistic fabric abutting and covering the face surface of the corrugated structural armor plate layer, the continuous ballistic fabric having physical properties including:

(i.) a tensile strength of 45,000 lb./in$^2$ or greater, (ii.) a Young's modulus of 700,000 lb./in$^2$ or greater, and (iii.) an elongation at break of 2% or greater; and (c.) the blast frequency control panel having a total projectile blockage perpendicular to the generally planar orientation, the total projectile blockage defined by the number 1.00 minus the sine of a half angle of the included intersection angle multiplied by a quotient of total traversing port lateral area divided by face surface area plus total traversing port lateral area.

2. The blast frequency control panel of claim 1, wherein: the traversing ports have diameters of 0.1 to 0.5 inches.

3. The blast frequency control panel of claim 1, wherein the corrugated structural armor plate layer has a thickness of 0.04 inches to 0.075 inches.

4. The blast frequency control panel of claim 1, wherein the corrugated structural armor plate layer has a thickness of 0.1 inches to 1 inch.

5. The blast frequency control panel of claim 1, wherein the ballistic fabric is selected to have an elongation at break of 4% or greater.

6. The blast frequency control panel of claim 1, wherein the ballistic fabric layer is in an amount to provide a uniform areal density of 0.02 lb./ft$^2$ or greater.

7. The blast frequency control panel of claim 1, wherein the ballistic fabric layer is in an amount to provide a uniform areal density of 0.02 lb./ft$^2$ to 0.06 lb./ft$^2$.

8. The blast frequency control panel of claim 1, wherein the total projectile blockage ranges from 0.7 to 0.9.

9. A method of making a generally planar blast frequency control panel including a strike surface layer abutting a corrugated structural armor plate layer, the method comprising:

(a.) forming sharp edged ports in the corrugated structural armor plate layer, the ports aligned in straight, parallel, equally spaced rows and having axes perpendicular to the structural armor plate layer, the ports having diameters of 0.1 to 0.5 inches;

(b.) forming a sufficient number of sharp edged ports in the corrugated structural armor plate layer to provide a face surface projectile blockage of 0.6 to 0.8, the face surface projectile blockage defined by the number 1.00 minus a quotient of total traversing port lateral area divided by face surface area plus total traversing port lateral area;

(c.) bending the structural armor plate to form straight, parallel V-shaped grooves at regular intervals, each V-shaped groove including a pair of straight, parallel rows of ports, and each pair of straight, parallel row of ports having axes intersecting at a 60° to 90° angle;

(d.) contacting and completely covering the structural armor plate with a strike surface layer, the strike surface layer comprising a continuous ballistic fabric layer having:

(i.) a tensile strength of 45,000 lb./in$^2$ or greater, (ii.) a Young's modulus of 700,000 lb./in$^2$ or greater, and (iii.) an elongation at break of at least 2%;

thereby producing a blast frequency control panel having a total projectile blockage perpendicular to the generally planar orientation, the total projectile blockage defined by the number 1.00 minus the sine of a half angle of the included intersection angle multiplied by a quotient of total traversing port lateral area divided by face surface area plus total traversing port lateral area.

10. The method of making a blast frequency control panel of claim 9, wherein the ballistic fabric layer has an elongation at break of 4% or greater.

11. The method of making a blast frequency control panel of claim 9, wherein the ballistic fabric layer is in an amount to provide a uniform areal density of 0.02 lb./ft$^2$ or greater.

12. The method of making a blast frequency control panel of claim 9, wherein the ballistic fabric layer is in an amount to provide a uniform areal density of 0.02 lb./ft$^2$ to 0.06 lb./ft$^2$.

13. The blast frequency control panel of claim 9, wherein the total projectile blockage ranges from 0.7 to 0.9.

* * * * *